US006394148B1

(12) United States Patent
Clarke

(10) Patent No.: US 6,394,148 B1
(45) Date of Patent: May 28, 2002

(54) PUMP CONNECTION

(75) Inventor: Michael T. Clarke, Alto, MI (US)

(73) Assignee: Root-Lowell Manufacturing Co., Lowell, MI (US)

( * ) Notice: Subject to any disclaimer, the term of this patent is extended or adjusted under 35 U.S.C. 154(b) by 0 days.

(21) Appl. No.: 09/792,994

(22) Filed: Feb. 26, 2001

(51) Int. Cl.[7] ..... B65B 1/04

(52) U.S. Cl. ..... 141/2; 141/18; 141/98; 222/400.8; 222/401; 222/402.16

(58) Field of Search ..... 141/2, 18, 98, 141/67, 64; 222/400.8, 400.7, 401, 402, 402.16, 192

(56) References Cited

U.S. PATENT DOCUMENTS

| | | | | |
|---|---|---|---|---|
| 313,077 | A | | 2/1885 | Hudson |
| 607,753 | A | | 7/1898 | Lawrason |
| 849,772 | A | | 4/1907 | Cordeaux |
| 850,805 | A | | 4/1907 | Stewart |
| 2,069,383 | A | | 2/1937 | Nedbalek |
| 2,211,823 | A | | 8/1940 | Jepson |
| 2,454,343 | A | | 11/1948 | Rotter et al. |
| 2,706,586 | A | * | 4/1955 | Sikorski |
| 3,756,513 | A | * | 9/1973 | Denninger |
| 4,022,347 | A | * | 5/1977 | Noble |
| 4,174,743 | A | | 11/1979 | Beny et al. |
| 5,072,884 | A | | 12/1991 | Ellison et al. |
| D327,528 | S | | 6/1992 | Sears et al. |
| 5,186,391 | A | | 2/1993 | Roueche et al. |
| 5,248,064 | A | * | 9/1993 | Claycomb, Jr. |

FOREIGN PATENT DOCUMENTS

| | | |
|---|---|---|
| FR | 735933 | 1/1930 |
| FR | 922027 | 1/1947 |
| GB | 11815 | 3/1903 |

OTHER PUBLICATIONS

RL Flo–Master WPX9001 Wallpaper Sprayer information sheet, 1994, 1 page.
RL Flo–Master Back Pack Sprayer information sheet, 1998, 1 page.
RL Flo–Master Accessories information sheet, 1995, 1 page.
RL Flo–Master Pro No Pumping Sprayer information sheet, 1995, 1 page.
RL Flo–Master Pro Plus No Pumping Sprayer information sheet, 1995, 1 page.
RL Flo–Master PGX Funnel Top Sprayer information sheet, 1995, 1 page.
RL Flo–Master LGX Funnel Top Sprayer information sheet, 1995, 1 page.
RL Flo–Master Optimum Plus Funnel Top Sprayer information sheet, 1995, 1 page.

(List continued on next page.)

*Primary Examiner*—Steven O. Douglas
(74) *Attorney, Agent, or Firm*—Price, Heneveld, Cooper, DeWitt & Litton

(57) ABSTRACT

A sprayer kit comprising a sprayer container adapted to be filled with a fluid, a hand pump for pressurizing fluid in the sprayer container and a fluid transfer device. The fluid transfer device is configured to be inserted into an opening in a commercial container, with the fluid transfer device being adapted to transport fluid from the commercial container to the sprayer container. The hand pump is adapted to be alternatively placed in the sprayer container for pressurizing fluid in the sprayer container and placed in the fluid transfer device for pressurizing the fluid in the commercial container to force the fluid in the commercial container through the fluid transfer device and into the sprayer container.

21 Claims, 3 Drawing Sheets

OTHER PUBLICATIONS

RL Flo–Master Optimum Funnel Top Sprayer information sheet, 1995, 1 page.
RL Flo–Master Wood & Masonry Sprayers information sheet, 1995, 1 page.
RL Flo–Master Commercial Sprayer Catalog including sprayers, service parts and accessories, flow controls and nozzles all sold more than one year prior to Feb. 26, 2001, 6 pages.
Home Depot Professional Sprayers information sheet including sprayers all sold more than one year prior to Feb. 26, 2001, 1 page.
Triple S Commercial Pressurized Sprayers information sheet, May 1998, 1 page.
RL Flo–Master Lawn & Garden Product Line Summary including sprayers, spare parts kits and accessories all sold more than one year prior to Feb. 26, 2001, 4 pages.

* cited by examiner

PUMP CONNECTION

BACKGROUND OF THE INVENTION

The present invention relates to sprayers, and in particular to portable sprayers for praying fluids.

Portable sprayers have been used to spray stains, sealants or protective coatings on decks, fences, brick walls, concrete walks, or other wood and masonry objects. Portable sprayers have also been used to spray acids, chemicals, pesticides, herbicides, degreasers, disinfectants, water proofing, carpet treatments, cleaners, sealers, curing compounds, form release agents, germicides, herbicides, insect control fluids, or any other fluid one would desire to spray onto an object.

Heretofore, portable sprayers have typically included a tank for holding the fluids, a pump in the tank for pressurizing the fluids in the tank and a spraying gun for spraying the fluids onto a predetermined object. The tanks of the portable sprayers usually included a top opening wherein the fluids are added to the tanks by pouring the fluids from one gallon or larger commercial containers into the tanks. To assist in this fluid transfer, some tanks have included funnel shaped openings in the top of the tanks for easily accepting the fluids from the commercial containers. However, even with the funneled tops, some of the fluid from the commercial containers would sometimes spill as the fluid is poured into the tank. Since the fluid typically comprises various chemicals, spillage of the fluids is very undesirable. Furthermore, the commercial containers typically are very large and heavy, and it can be difficult for one person to lift the commercial container and tilt the commercial container such that the fluid in the commercial container will flow into the top of the tanks.

Accordingly, a practical, economical packaging system solving the aforementioned disadvantages and having the aforementioned advantages is desired.

SUMMARY OF THE INVENTION

The apparatus and methods of the present invention utilize a fluid transfer device configured to be inserted into an opening in a commercial container, to transport fluid from the commercial container to a sprayer container. A hand pump is adapted to be alternatively placed in the sprayer container for pressurizing fluid in the sprayer container and placed in the fluid transfer device for pressurizing fluid in the commercial container to force the fluid in the commercial container through the fluid transfer device and into the sprayer container.

The principal objects of the present invention are to provide a spraying kit that can be used to transfer a fluid from a commercial container to a spraying container without spilling any of the fluid. When a spraying container, a spraying gun, a hand pump and a fluid transfer device of the present invention are combined in a kit, fluid from various commercial containers can be transferred easily to the sprayer container without spilling. The spraying kit is efficient in use, economical to manufacture, capable of a long operable life, and particularly adapted for the proposed use.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
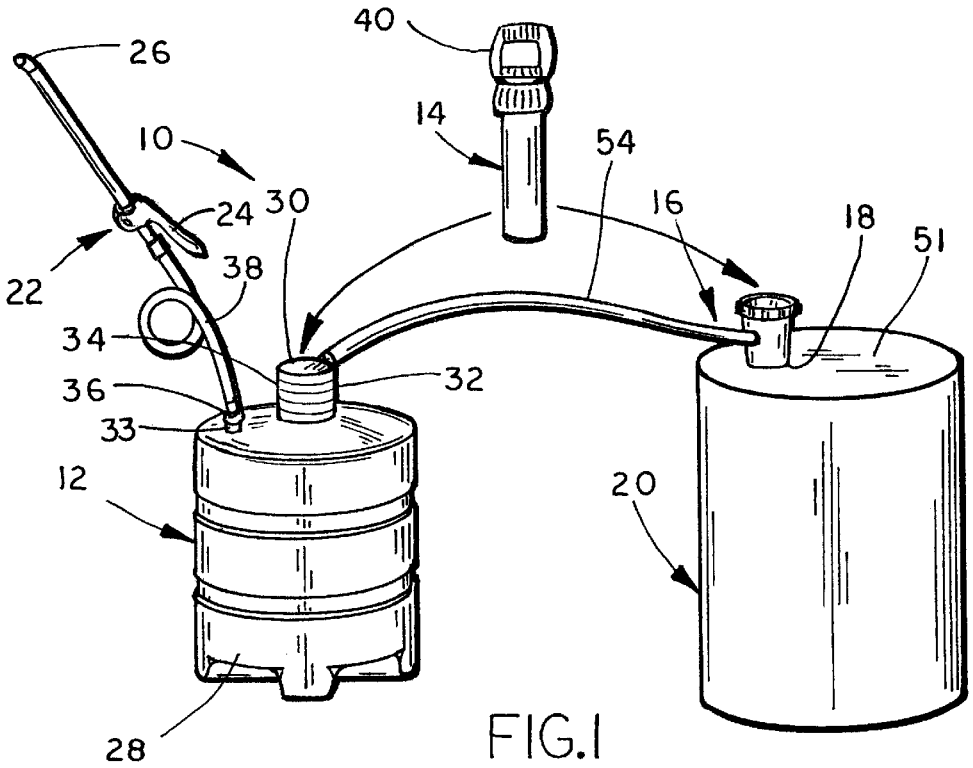
FIG. 1 is a perspective view of a sprayer kit and commercial container embodying the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a sprayer kit embodying the present invention. In the illustrated example, a sprayer kit 10 includes a sprayer container 12 adapted to be filled with a fluid, a hand pump 14 for pressurizing fluid in the sprayer container 12 and a fluid transfer device 16. The fluid transfer device 16 is configured to be inserted into an opening 18 in a commercial container 20, with the fluid transfer device 16 being adapted to transport fluid from the commercial container 20 to the sprayer container 12. The hand pump 14 is adapted to be alternatively placed in the sprayer container 12 for pressurizing fluid in the sprayer container 12 and placed in the fluid transfer device 16 for pressurizing the fluid in the commercial container 20 to force the fluid in the commercial container 20 through the fluid transfer device 16 and into the sprayer container 12.

The illustrated sprayer container 12 is preferably used to spray a fluid located within the sprayer container 12 onto a predetermined object for covering the object with the fluid. The hand pump 14 connects to the sprayer container 12 and is actuated to pressurize the fluid in the sprayer container 12. A spraying gun 22 also connects to the sprayer container 12 for spraying the pressurized fluid. In use, the fluid in the spraying container 12 is pressurized with the hand pump 14 and a handle 24 on the spraying gun 22 is depressed to eject the fluid out of a nozzle 26 of the spraying gun 22. Preferably, the sprayer container 12 holds a stain, a sealant or a protective coating for application to a deck, fences, brick walls, concrete walks, or other wood and masonry objects. The sprayer container 12 could also hold acids, chemicals, pesticides or herbicides for spraying chemicals, degreasers, disinfectants, water proofing, carpet treatments or cleaners for janitorial use, sealers, curing compounds or form release agents for concrete, germicides, herbicides or insect control fluids for agricultural use, or any other fluid to be sprayed.

In the illustrated example, the sprayer container 12 includes feet 28 for maintaining the sprayer container 12 in an upright position and an open top 30. The feet 28 maintain the sprayer container 12 upright so that any fluid in the sprayer container 12 will not spill out of the sprayer container 12. The open top 30 includes a tubular neck 32 with an outside threaded surface 34 for connection to the hand pump 16. Alternatively, the neck 32 can be flared outward for ease of filling and pouring out leftover fluid. When the neck 32 is flared outward, the neck 32 preferably includes an inside threaded surface for connection to the hand pump 16. The sprayer container 12 also includes a male connection 33 for coupling with a female connection 36 of a hose 38 of the spraying gun 26 to connect the sprayer container 12 to the spraying gun 22. The sprayer container 12 is preferably blow-molded out of a high-density polyethylene and is translucent such that the level of fluid in the sprayer container 12 can readily be seen. The sprayer container 12 could also include a pressure relief valve or a carrying strap (not shown).

Figure 2:
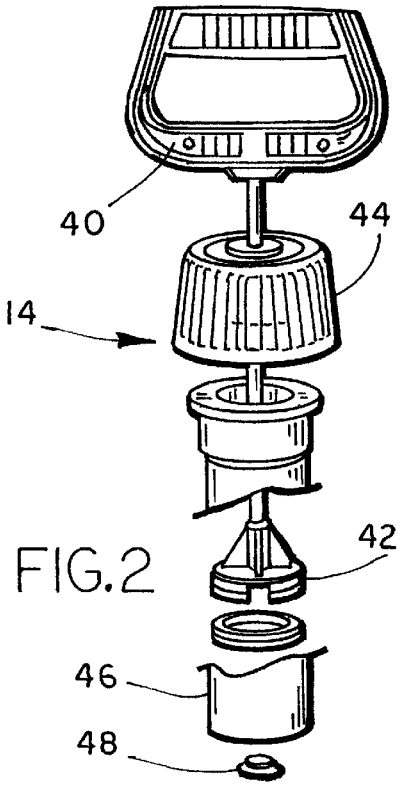
FIG. 2 is a cross-sectional view of a hand pump of the preferred embodiment.

The illustrated hand pump 14 (FIG. 2) includes a handle 40, a plunger 42, a sleeve 44 and a cylinder 46. The plunger 42 extends into the cylinder 46 from the handle 40, and the handle 40 is actuated up and down to force air towards the bottom of the cylinder 46 with the plunger 42. A check valve 48 is located in the bottom of the cylinder 46 so that the air forced towards the bottom of the cylinder 46 can escape through the check valve 48, but air cannot enter the cylinder 46 through the check valve 48. The sleeve 44 extends downward and outward over the cylinder 46 and includes an inside threaded surface (not shown). The hand pump 14 is connected to the spraying container 12 by inserting the cylinder 46 into the open top 30 of the spraying container 12 and screwing the sleeve 44 about the tubular neck 32. Once the sleeve 44 is screwed fully onto the tubular neck 32, an air tight seal is created in the open top 30 of the spraying container 12. The fluid in the spraying container 12 is pressurized by repetitively pressing down on the handle 40 of the hand pump 14 and forcing air into the spraying container 12. If the neck of the spraying container is flared outward as described above, the cylinder 46 of the hand pump 14 could have an outside threaded surface instead of the sleeve 44 for connecting the hand pump 14 to the spraying container 12. The spraying container 12, the hand pump 14 and the spraying gun 22 described above are currently sold as Model 1992D Wood & Masonry Sprayer by Root-Lowell Manufacturing Company of Lowell, Mich.

In the illustrated example, the commercial container 20 initially contains the fluid to be used in the spraying container 12. The commercial container 20 typically includes the opening 18 located in a top surface 51 of the commercial container 20 for accessing the fluid located in the commercial container 20. The opening 18 in the top surface 51 has an annular shape. The fluid transfer device 16 is inserted into the opening 18 for transporting the fluid in the commercial container 20 to the sprayer container 12.

Figure 3:
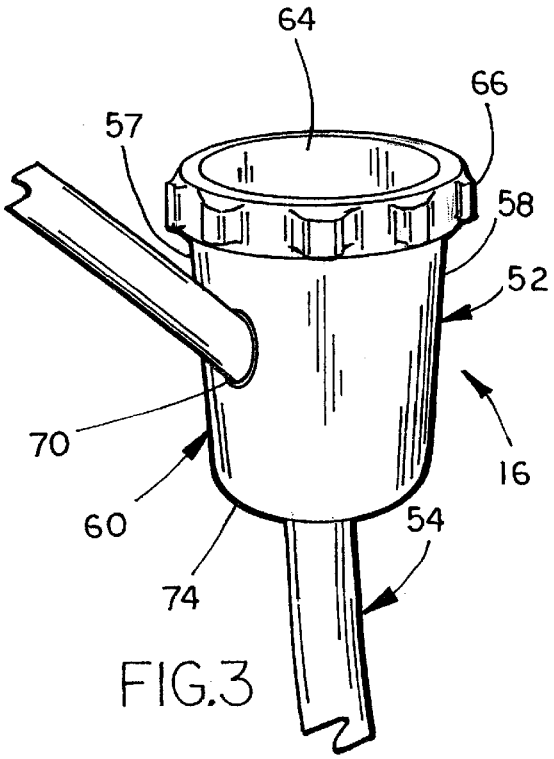
FIG. 3 is a perspective view of a fluid transfer device of the first alternative embodiment of the present invention.
Figure 5:
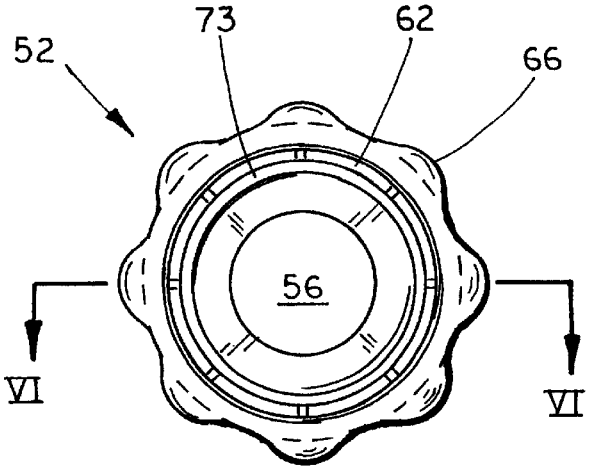
FIG. 5 is a top view of the fluid transfer device of the first alternative embodiment of the present invention.
Figure 4:
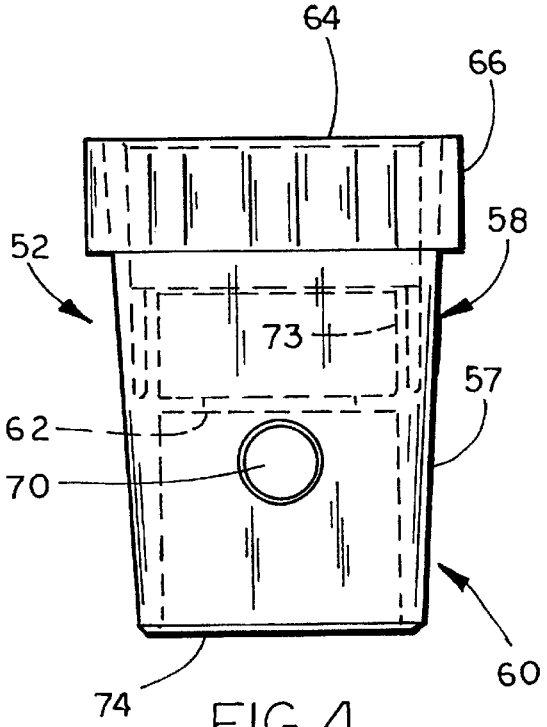
FIG. 4 is a side view of the fluid transfer device of the first alternative embodiment of the present invention.
Figure 6:
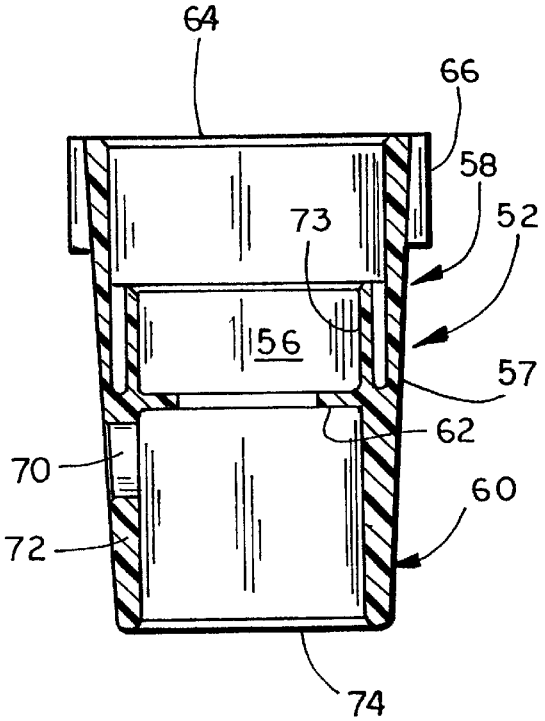
FIG. 6 is a cross-sectional view of the fluid transfer device of the first alternative embodiment of the present invention taken along the line VI—VI of FIG. 5.

The illustrated fluid transfer device 16 includes a body 52 (FIGS. 3–6) and a tube 54 (FIG. 3). The body 52 has a substantially tubular cross-section with a longitudinal passage 56 and a tapered, funnel shaped outer surface 57. The body 52 includes an upper portion 58 and a lower portion 60 defined in the preferred embodiment by an internal ring-shaped annular horizontal flange 62. The upper portion 58 of the body 52 includes an aperture 64 leading to the passage 56. The passage 56 in the upper portion 58 is tapered inward towards the lower portion 60 of the body 52. The upper portion 58 of the body 52 also includes an undulated outer grip 66. As explained in more detail below, the grip 66 is used to remove the fluid transfer device 16 from the commercial container 20. The lower portion 60 of the body 52 includes an orifice 70 through a side wall 72 of the body 52 into the passage 56. The body 52 also includes a cylindrical flange 73 extending upwards from the ring-shaped annular flange 62 towards the aperture 64 of the upper portion 58 of the body 52. The body 52 is preferably made of polypropylene. The tube 54 is preferably flexible tubing extending into the body 52 through the side wall 72 of the lower portion 60, into the passage 56 and out of the body 52 through a hole 74 in the bottom 76 of the lower portion 60.

The fluid transfer device 16 is used to transfer fluid from the commercial container 20 to the spraying container 12 by first inserting the body 52 into the opening 18 in the top surface 51 of the commercial container 20. The body 52 is pressed into the opening 18 until the outer surface 57 of the lower portion 60 is wedged into the opening 18. The body 52 should be wedged into the opening 18 until an air tight seal is created. The diameter of the lower portion 60 of the body 52 should be larger than the diameter of the opening 18 at a position below the orifice 70 in the side wall 72 of the lower body 52. Therefore, the tube 54 will extend out of the body 52 through the side wall 72 of the body 52 at a location above the top surface 51 of the commercial container 20. The tube 54 is preferably allowed to slide within the orifice 70 in the side wall 72 of the lower portion 60 of the body 52 such that a first end of the tube 54 will always be adjacent the bottom of the commercial container 20. Therefore, the tube 54 can be slid towards the bottom of larger commercial containers 20. Alternatively, the tube 54 can be fixed to the body 52 and can flex into a circular shape at the bottom of the commercial container 20 if the tube 54 extends from the hole 74 in the lower portion 60 to a position farther than the bottom of the commercial container 20.

The cylinder 46 of the hand pump 16 is then inserted into the aperture 64 in the upper portion 58 of the body 52. Since the passage 56 in the upper portion 58 is tapered inward towards the lower portion 60 of the body 52, the cylinder 46 of the hand pump 16 is wedged into the passage 56. The cylinder 46 should be wedged into the passage 56 until an air tight seal is created. Preferably the cylinder 46 will rest on the cylindrical flange 73 extending upwards from the ring-shaped flange 62. The cylindrical flange 73 has a diameter larger than the diameter of the check valve 48 of the hand pump 16 so that air entering the body 52 through the check valve 48 will be forced through a bore 80 in the ring-shaped flange 62 and into the lower portion 60 of the body 52.

A second end of the tube 54 is then placed into the top opening 30 of the spraying container 12. The handle 40 of the hand pump 16 is thereafter repetitively pressed up and down to force air through the check valve 48, into the body 52, through the hole 74 in the lower portion 60 of the body 52 and into the commercial container 20. The fluid in the commercial container 20 will therefore become pressurized and will be forced up through the first end of the tube 54 and out of the second end of the tube 54 into the spraying container 12.

The hand pump 14 is removed from the fluid transfer device 16 when the spraying container 12 is filled with the fluid and screwed onto the spraying container 12. The body 52 is also removed from the opening 18 in the commercial container 20 by grabbing the grip 66 and simultaneously turning and pulling on the body 52. The spraying container 12 is therefore filled with a fluid without any spillage and ready to be used to spray the fluid onto any object a user of the spraying gun 22 desires.

The reference numeral 16*a* (FIGS. 7–9) generally designates a second preferred embodiment of the invention, having a second preferred embodiment of the fluid transfer device. Since fluid transfer device 16*a* is similar to the previously described fluid transfer device 16, similar parts appearing in FIGS. 1–6 and FIGS. 7–9, respectively, are represented by the same, corresponding reference numeral, except for the suffix "a" in the numerals of the latter. The fluid transfer device 16*a* is preferably used to transport a fluid to the sprayer container 12 from a commercial container 20*a* similar to a one gallon paint can, wherein the top surface of the commercial container 20*a* comprises the annular opening 18*a*.

Figure 7:
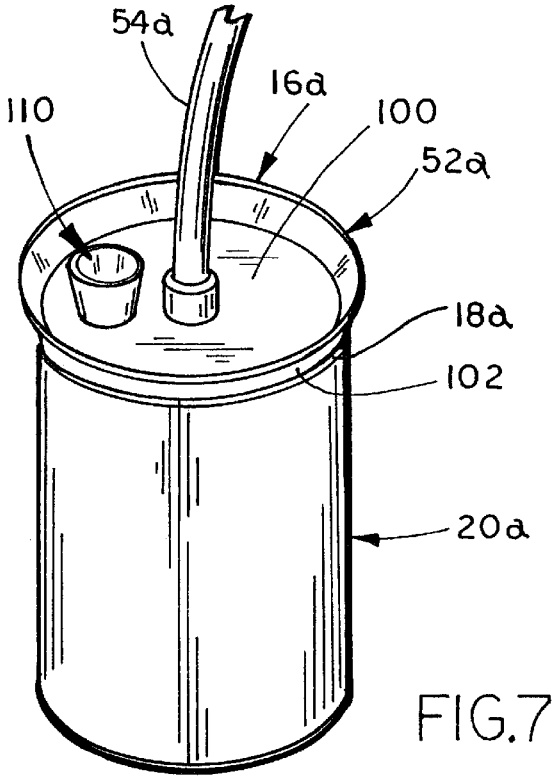
FIG. 7 is a perspective view of a fluid transfer device in a commercial container of the second alternative embodiment of the present invention.
Figure 8:
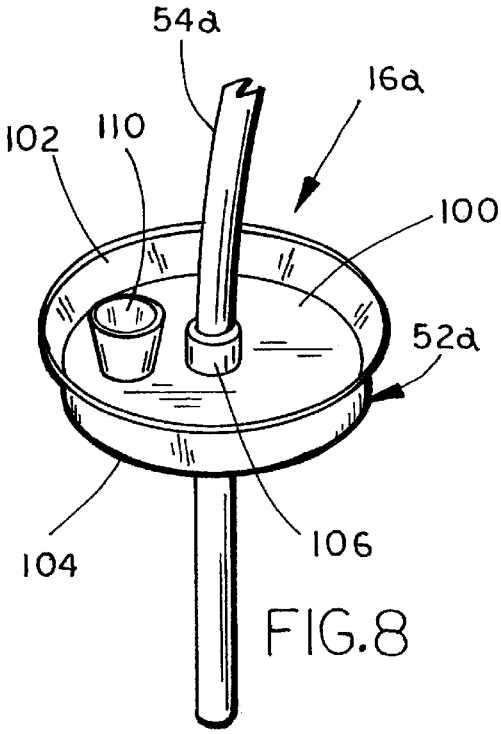
FIG. 8 is a perspective view of the fluid transfer device of the second alternative embodiment of the present invention.
Figure 9:
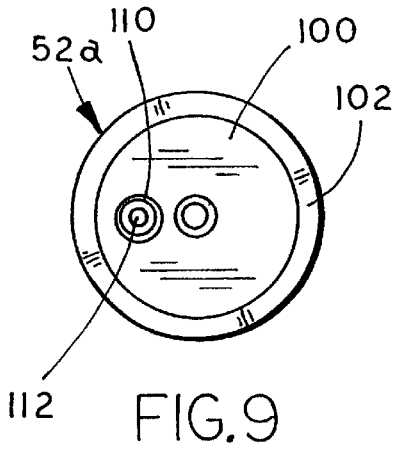
FIG. 9 is a top view of the fluid transfer device of the second alternative embodiment of the present invention.

The illustrated fluid transfer device 16*a* includes a body 52*a* and a tube 54*a*. The body 52*a* includes a plate 100 and an outside funnel-shaped annular wall 102 extending from the plate 100. The body 52*a* also includes a cylindrical flange 104 extending downward from the bottom surface of the plate 100. The body 52*a* is configured to be inserted into the annular opening 18*a* of the commercial container 20*a* by first inserting the cylindrical flange 104 in the in the annular opening 18*a* of the commercial container 20*a* by first inserting the cylindrical flange 104 in the annular opening 18*a* and then forcing the outside funnel-shaped wall 102 to wedge in the annular opening 18*a* to create an air tight seal. Although the outside funnel-shaped wall 102 is shown in FIGS. 7 and 8 as extending upwards and outwards from the perimeter of the plate 100, it is contemplated that the cylindrical flange 104 could be removed from the body 52*a* and the outside funnel-shaped wall 102 could extend downward and inward from the plate 100. The illustrated tube 54*a* extends through the plate 100. As seen in FIG. 8, a first portion of the tube 54*a* is connecting to a fitting 106 extending upward from the plate 100 and a second portion of the tube 53*a* extends downward from the plate 100 below the fitting 106 to create a fluid path. It is contemplated that the tube 54*a* could also comprise a one piece tube extending through the plate 100. Both confirmations of the tube are considered to comprise a tube extending through the plate 100. Furthermore, any fluid path is considered to comprise a tube extending through the plate 100. In the illustrated example, the body 52*a* of the fluid transfer device 16*a* also includes a funnel shaped wall 110 extending from a central portion of the plate 100. An opening 112 is located in the plate 100 within the funnel shaped wall 100.

In use, the fluid transfer device 16*a* is used to transfer a fluid from the commercial container 20*a* to the spraying container 12 by first wedging the body 52*a* of the fluid transfer device 16*a* into the annular opening 18*a* of the commercial container 20*a*. The cylinder 46 of the hand pump 16 is then inserted into the funnel shaped wall 110 of the body 52*a*. Since the funnel shaped wall 110 is tapered inwards towards the body 52*a*, the cylinder 46 of the hand pump 16 is wedged in the funnel shaped wall 110. The cylinder 46 should be wedged into the funnel shaped wall 110 until an air tight seal is created.

A second end of the tube 54*a* is then placed into the top opening 30 of the spraying container 12. The handle 40 of the hand pump 14 is thereafter repetitively pressed up and down to force air through the check valve 48 and into the commercial container 20*a*. The fluid in the commercial container 20*a* will become pressurized and will be forced up through the tube 54*a* and out of the tube 54*a* into the spraying container 12 to thereby fill the spraying container 12.

In the forgoing description, it will be readily appreciated by those skilled in the art that modifications may be made to the invention without departing from the concepts disclosed herein. Such modifications are to be considered as included in the following claims, unless these claims by their language expressly state otherwise.

I claim:

1. A sprayer kit comprising:

a sprayer container adapted to be filled with a fluid;

a hand pump for pressurizing fluid in said sprayer container; and a fluid transfer device configured to be inserted into an opening in a commercial container, said fluid transfer device adapted to transport fluid from the commercial container to said sprayer container;

wherein said hand pump is adapted to be alternatively placed in said sprayer container for pressurizing fluid in said sprayer container and placed in said fluid transfer device for pressurizing the fluid in the commercial container to force the fluid in the commercial container through the fluid transfer device and into said sprayer container.

2. The sprayer kit as defined in claim 1, wherein:

said fluid transfer device includes a body and a tube;

said body being configured to be wedged into the opening in the commercial container; and said tube being configured to extend through said body and between the commercial container and said sprayer container.

3. The sprayer kit as defined in claim 2, wherein:

said body includes an upper portion for removably accepting said hand pump and a lower portion including a tapered outer surface for wedging said body into the opening on the commercial container, wherein said tube extends through a side wall of said body and through a hole in the bottom of said lower portion.

4. The sprayer kit as defined in claim 3, wherein:

said upper portion includes a passage, said hand pump being accepted by said upper portion by inserting said hand pump into said passage, said passage including an inside taper for frictionally engaging said hand pump.

5. The sprayer kit as defined in claim 4, wherein:

said upper portion has an undulated outer grip for assisting in turning said body to thereby remove said fluid transfer device from the opening in the commercial container.

6. The sprayer kit as defined in claim 5, wherein:

said body including an internal annular flange defining said upper portion and said lower portion of said body.

7. The sprayer kit as defined in claim 6, further including:

a spraying gun adapted to be connected to said sprayer container for spraying pressurized fluid in said sprayer container onto a predetermined object.

8. The sprayer kit as defined in claim 2, wherein:

said body includes a plate, an outside tapered wall extending from said plate, an inside tapered wall extending from a central portion of said plate for accepting said hand pump and an opening through said plate within said inside tapered wall for allowing pressurized air from said hand pump to enter the commercial container, wherein said tube extends through said plate.

9. A method of transporting fluid from a commercial container to a sprayer container comprising:

providing a fluid transfer device;

inserting said fluid transfer device into an opening in said commercial container;

placing a hand pump in said fluid transfer device;

pressurizing said fluid in said commercial container with said hand pump;

transporting fluid from said commercial container to said sprayer container with said fluid transfer device;

removing said hand pump from said fluid transfer device; and inserting said hand pump into said sprayer container.

10. The method of transporting as defined in claim 9, further including the step of:

pressurizing said fluid in said sprayer container with said hand pump.

11. The method of transporting as defined in claim 10, further including the step of:

spraying said fluid in said sprayer container onto a predetermined object with a spraying gun.

12. The method of transporting as defined in claim 9, wherein:

said fluid transfer device includes a body and a tube;

said step of inserting said fluid transfer device into an opening in said commercial container includes wedging into said opening in said commercial container; and further including the step of extending said tube through said body and between said commercial container and said sprayer container.

13. The method of transporting as defined in claim 12, wherein:

said body includes an upper portion for removably accepting said hand pump, a lower portion including a tapered outer surface for wedging said body into said opening on said commercial container, wherein said tube extends through a side wall of said body and through a hole in the bottom of said lower portion.

14. The method of transporting as defined in claim 13, wherein:

said upper portion includes a passage, said passage including an inside taper for frictionally engaging said hand pump;

wherein the step of placing said hand pump in said fluid transfer device includes inserting said hand pump into said passage of said upper portion.

15. The method of transporting as defined in claim 14, wherein:

said upper portion has an undulated outer grip for assisting in turning said body.

16. The method of transporting as defined in claim 15, wherein:

said body including an internal annular flange defining said upper portion and said lower portion of said body.

17. The method of transporting as defined in claim 12, wherein:

said body includes a plate, an outside tapered wall extending from said plate, an inside tapered wall extending from a central portion of said plate for accepting said hand pump and an opening through said plate within said inside tapered wall for allowing pressurized air from said hand pump to enter said commercial container, wherein said tube extends through said plate.

18. A fluid transfer device for transporting fluid from a commercial container to a sprayer container with a hand pump comprising:

a body having a plate, an outside tapered wall extending from said plate and tubing extending through said plate, said body further including an inside tapered wall extending from a central portion of said plate for accepting the hand pump and an opening through the plate within said inside tapered wall for allowing air from the hand pump to enter the commercial container;

wherein said body is configured to be inserted into an opening in the commercial container and said inside tapered wall is configured to accept the hand pump such that air from the hand pump can pressurize fluid in the commercial container to force the fluid in the commercial container through said tubing and into the sprayer container.

19. A fluid transfer device for transporting fluid from a commercial container to a sprayer container with a hand pump comprising:

a body being configured to be wedged into an opening in the commercial container, said body including an upper portion for removably accepting the hand pump, a lower portion including a tapered outer surface for wedging said body into the opening on the commercial container, said upper portion further including a passage having an inside taper for frictionally engaging the hand pump, and a tube extending through said body through a side wall of said body and through a hole in the bottom of the lower portion, said tube being configured to transport fluid from the commercial container to the sprayer container;

wherein said body is configured to be inserted into the opening in the commercial container and said upper portion is configured to accept the hand pump such that air from the hand pump can pressurize fluid in the commercial container to force the fluid in the commercial container through said tube and into the sprayer container.

20. The fluid transfer device as defined in claim 19, wherein:

said upper portion has an undulated outer grip for assisting in turning said body.

21. The fluid transfer device as defined in claim 20, wherein:

said body including an internal annular flange defining said upper portion and said lower portion of said body.

* * * * *

UNITED STATES PATENT AND TRADEMARK OFFICE

CERTIFICATE OF CORRECTION

PATENT NO. : 6,394,148 B1
DATED : May 28, 2002
INVENTOR(S) : Michael T. Clarke

It is certified that error appears in the above-identified patent and that said Letters Patent is hereby corrected as shown below:

Column 1,
Line 5, “praying” should be -- spraying --.

Column 5,
Line 27, delete “in the” (second occurrence).
Line 39, “connecting” should be -- connected --.

Signed and Sealed this

Fourteenth Day of January, 2003

JAMES E. ROGAN
*Director of the United States Patent and Trademark Office*